US009339152B1

(12) United States Patent
Gallimore

(10) Patent No.: US 9,339,152 B1
(45) Date of Patent: May 17, 2016

(54) BACK AND BODY WASHING DEVICE

(71) Applicant: Ellsworth Gallimore, Maitland, FL (US)

(72) Inventor: Ellsworth Gallimore, Maitland, FL (US)

( * ) Notice: Subject to any disclaimer, the term of this patent is extended or adjusted under 35 U.S.C. 154(b) by 0 days.

(21) Appl. No.: 14/541,705

(22) Filed: Nov. 14, 2014

(51) Int. Cl.
*A47K 7/02* (2006.01)

(52) U.S. Cl.
CPC .. *A47K 7/022* (2013.01); *A47K 7/02* (2013.01)

(58) Field of Classification Search
CPC ..... A47K 7/02; A47K 7/022; A47K 7/08
USPC ..... 15/222; 401/8
See application file for complete search history.

(56) References Cited

U.S. PATENT DOCUMENTS 1,334,716 A * 3/1920 Shont ..... 15/222
3,720,205 A * 3/1973 Liebman ..... A61H 11/00 15/222
4,187,575 A * 2/1980 Collins ..... A47K 7/022 15/222
4,512,054 A * 4/1985 Clark ..... A47K 7/03 15/210.1
4,597,121 A * 7/1986 Bouma ..... A41B 13/06 2/69
6,694,563 B2 * 2/2004 Onwugbonu ..... A47K 7/02 15/118
6,851,154 B1 * 2/2005 Neff ..... A45D 34/04 15/209.1
2002/0146956 A1 * 10/2002 Ngai ..... A47K 7/02 442/381

* cited by examiner

*Primary Examiner* — Monica Carter
*Assistant Examiner* — Stephanie Berry
(74) *Attorney, Agent, or Firm* — Jason T. Daniel, Esq.; Daniel Law Offices, P.A.

(57) ABSTRACT

A back and body washing device includes a main body having a central portion and a top and bottom handle portion extending outward therefrom. The main body being constructed from a soft fabric material and including an inner liner that is constructed from an interface material.

14 Claims, 4 Drawing Sheets

BACK AND BODY WASHING DEVICE

TECHNICAL FIELD

The present invention relates generally to improvement in body washing articles, and more particularly to a back and body washing device that allows the user to easily wash their back.

BACKGROUND

The statements in this section merely provide background information related to the present disclosure and may not constitute prior art.

There are many known forms of backwashing devices in the art. For example, one commonly utilized device includes a hardened back scrubber wherein a central member houses a plurality of bristles that are designed to scrape and exfoliate the skin on a user's back. Another commonly utilized device includes specially made towels having an elongated construction so as to allow a user to run the towel body across their back.

To this end, utilization of the soft elongated towels is much more soothing than the hardened back scrubber; however, the soft nature of these towels often causes them to fold and/or lose their shape when making contact with the users back. As such, the user must make several awkward movements and/or contortions of their body to ensure the towel cleans their entire back.

In light of the above, it would be beneficial to provide a back and body washing device that combines the soft and comfortable nature of a traditional towel with the ability to maintain a specific shape during use.

SUMMARY OF THE INVENTION

The present invention is directed to a back and body washing device. One embodiment of the present invention can include a main body having a central portion and a top and bottom handle portion extending outward therefrom. The central portion can be constructed from one or more pieces of soft cotton terrycloth having a liner positioned therebetween.

In another embodiment, the liner can be constructed from an interface material which can function to prevent the shape of the main body from changing during device operation.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
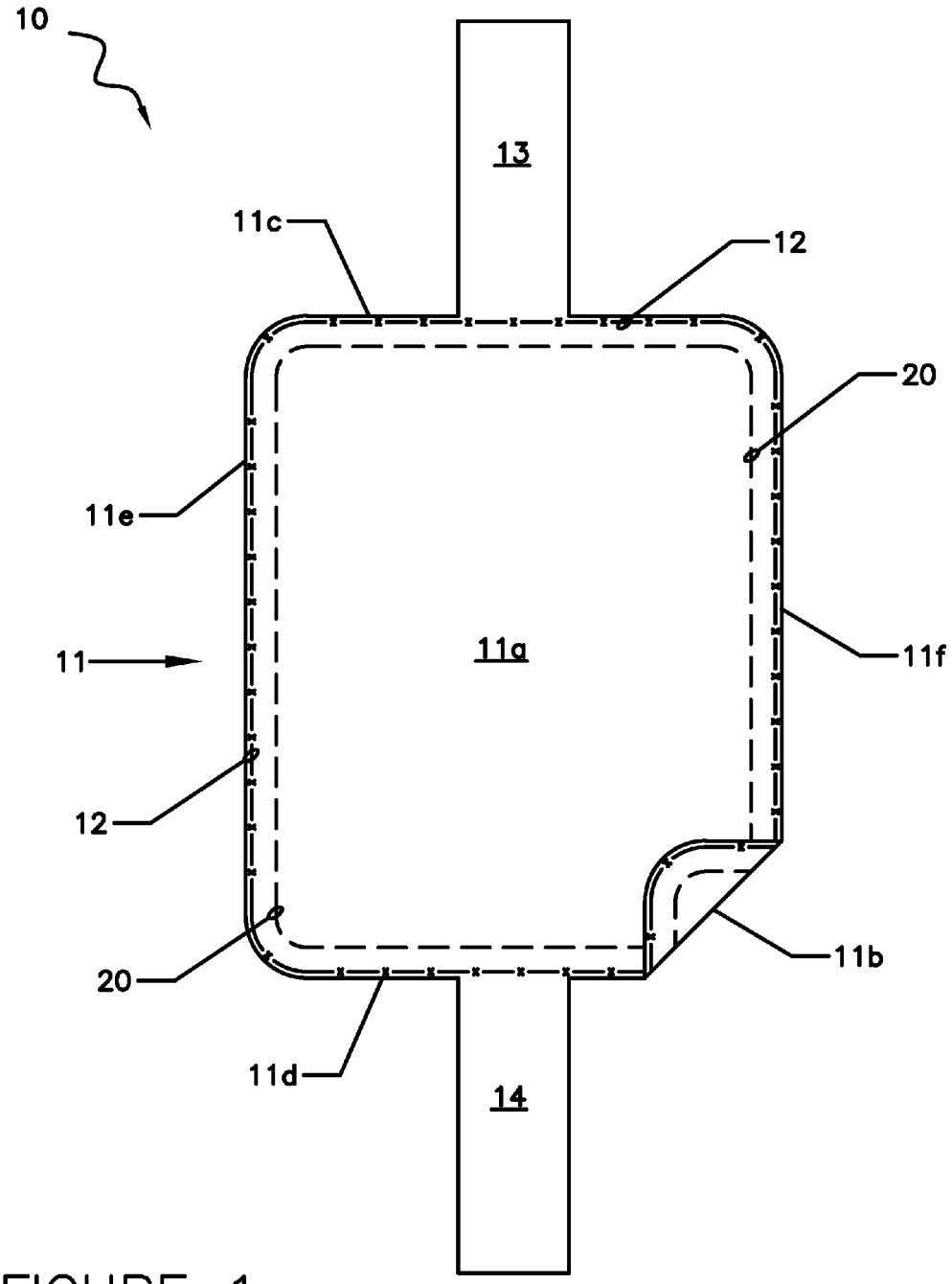
FIG. 1 is a front view of a back and body washing device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a back and body washing device 10 that is useful for understanding the inventive concepts disclosed herein.

As shown, the device body can include a substantially rectangular central portion 11 having a front surface 11*a* and a rear surface 11*b*. Front and rear surfaces can preferably include a pair of individual rectangular fabric elements that are joined together via one or more seam connectors 12, such as sewed stitches, for example, along the top, bottom and opposing side edges, 11*c*, 11*d*, 11*e* and 11*f*, respectively.

A pair of soft, elongated handle sections 13 and 14 can extend outward from the top and bottom edges of the central portion 11. Each of these handle sections can also be secured to the central section via seam connectors 12, or can be integral to the construction of the central portion.

In either instance, each of the central portion 11 and the handle sections 12 and 13 can preferably be constructed from a soft and absorbent cloth material such as terrycloth cotton, for example. Cotton is a common and widely accepted material for towels and other such articles that are safe for direct and prolonged exposure to human skin. Of course any number of other fabrics and/or materials can also be used for the device body. Several nonlimiting examples include natural materials such as wool, and/or synthetic materials such as polyester or rayon, for example. Additionally, each of the handle sections 13 and 14 can be constructed from different material than each other and/or the central portion 11.

Although described above as including a generally rectangular shaped central portion having a plurality of stitches, one of skill in the art will recognize that the device 10 can include any number of different shapes and sizes which can be formed utilizing a variety of known manufacturing techniques and seam connectors which include, for example, liquid seams, hem tape and the like.

The liner section 20 can function to prevent the central portion 11 of the main body from folding and/or losing its shape during device operation. In one embodiment, the liner 20 can include a generally lightweight interfacing material such as the commercially available Pellon® material, having a fiber makeup of approximately 85% polyester and 15% viscose. To this end, the liner can also include a shape and dimension that approximates the shape and dimension of the central portion of the device body 11, so as to be interposed between the front and back surfaces 11*a* and 11*b*, respectively.

Although described above as being located only within the central portion, other embodiments are contemplated wherein the liner 20 can be provided within one or both of the handle sections 13 and 14. Of course, any number of other known stabilizing materials and/or fiber makeups capable of withstanding the rigors of repeated use and laundering can also be utilized herein. As described above, withstanding laundering can include the ability for the device to be sent through a conventional washing machine and dryer repeatedly without diminishing the effectiveness of the stabilizing material.

Although dimensions are not critical, in one preferred embodiment, the central portion 11 can include a length (edges 11*c* to 11*d*) of approximately 11 inches, and a width (edges 11*e* to 11*f*) of approximately 9 inches. Likewise, each of the handle sections 13 and 14 can include a length of approximately 7 inches, and a width of approximately 4 inches. However, it will be apparent to those skilled in the art that the exact dimensions of the device 10 may vary from these amounts without departing from the overall spirit and scope of the present invention. As such, any number of other shapes and dimensions are contemplated.

Figure 2:
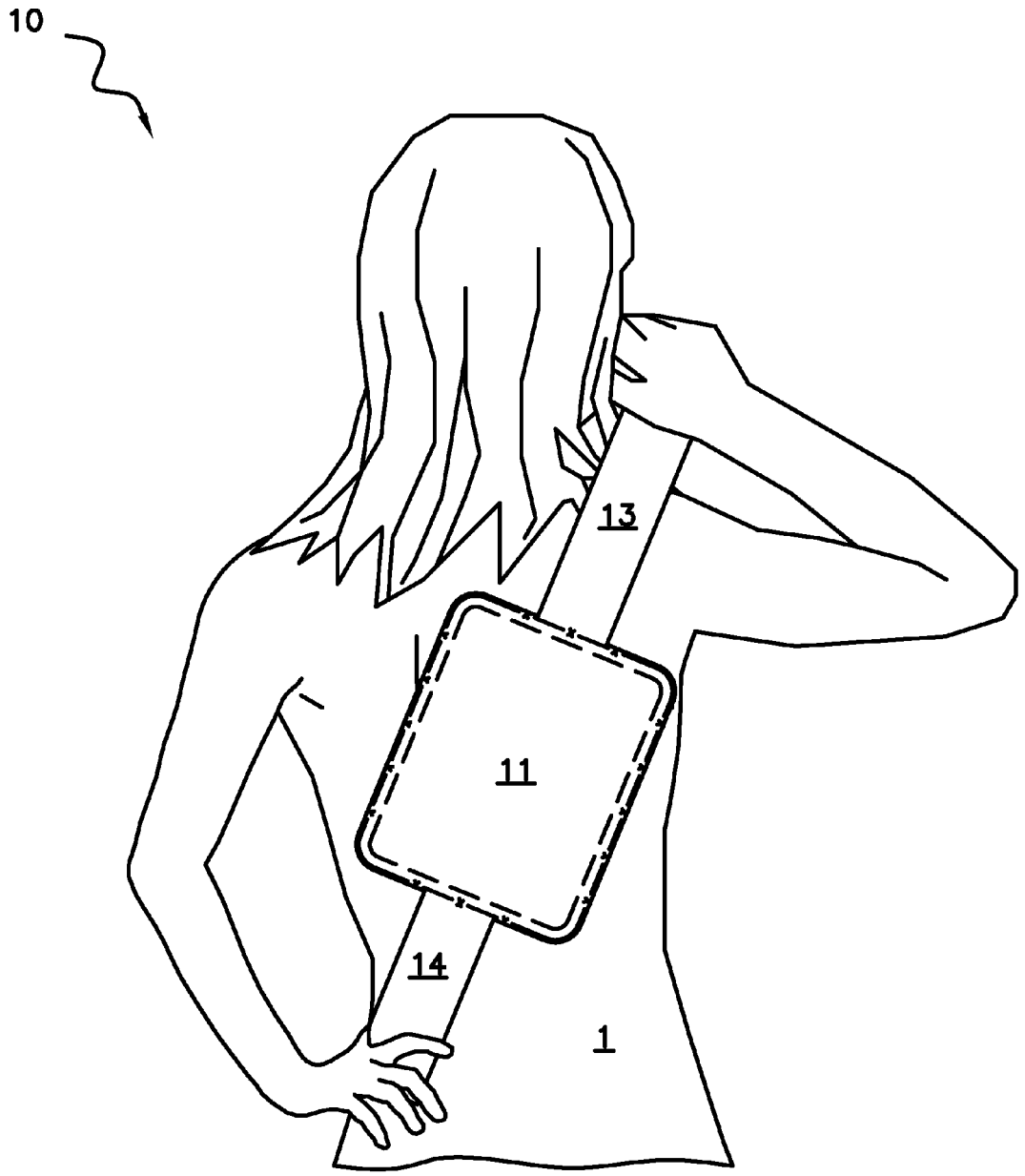
FIG. 2 is a perspective view of the back and body washing device in operation, and in accordance with one embodiment of the invention.

FIG. 2 illustrates one embodiment of the device 10 in operation. As shown, the user 1 can position the device so that the center portion 11 is located against their back. Then, he or she can alternate pulling each of the handles 13 and 14 so as to slide the device across their back. In this regard, by incorporating the interfacing material between the soft layers of the central portion, the device can function to offer the soft smooth feel of a fresh towel in both wet and dry conditions, without altering the shape of the device and diminishing the effectiveness of the same.

Figure 3:
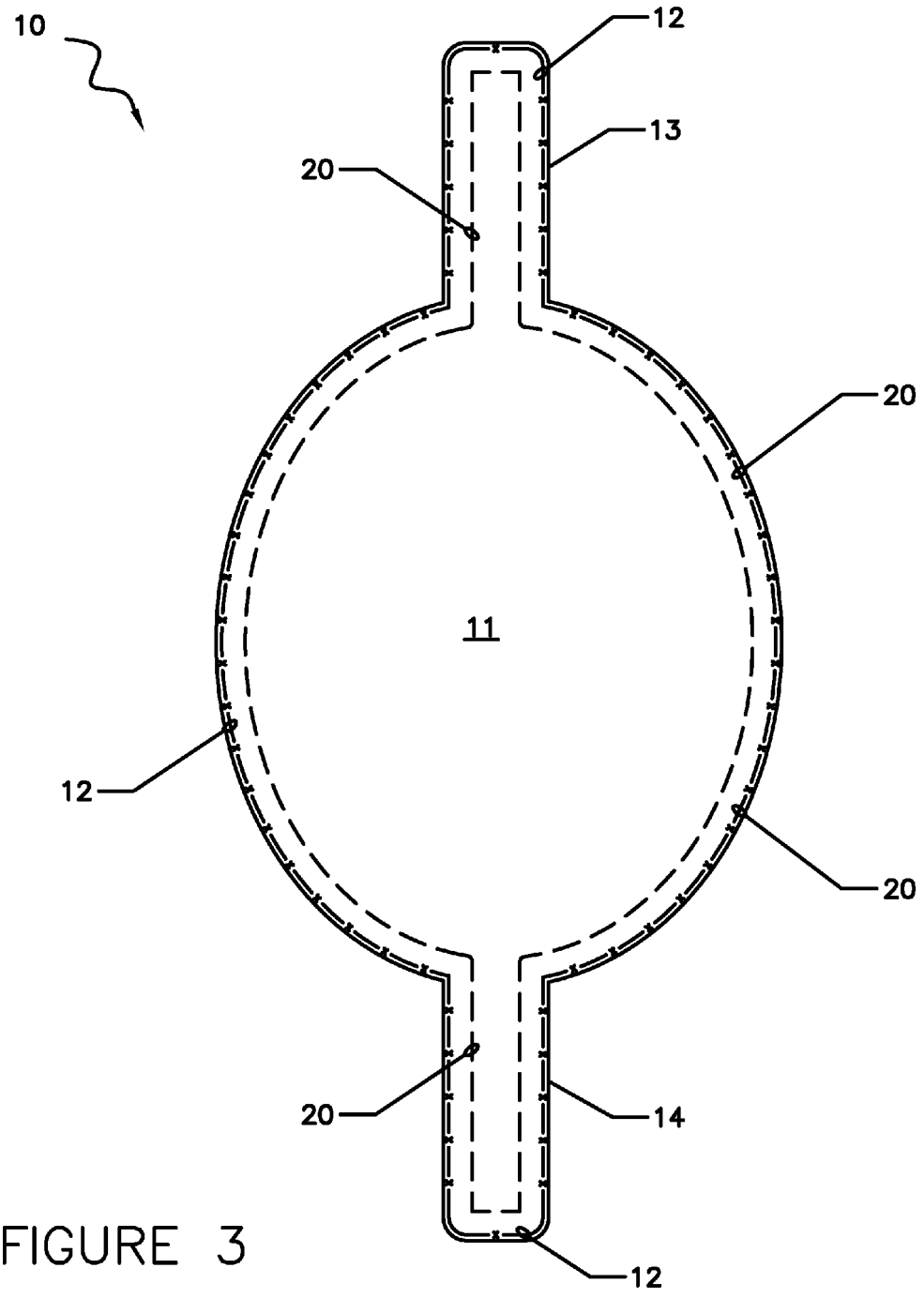
FIG. 3 is a front view of a back and body washing device, in accordance with another embodiment of the invention.
Figure 4:
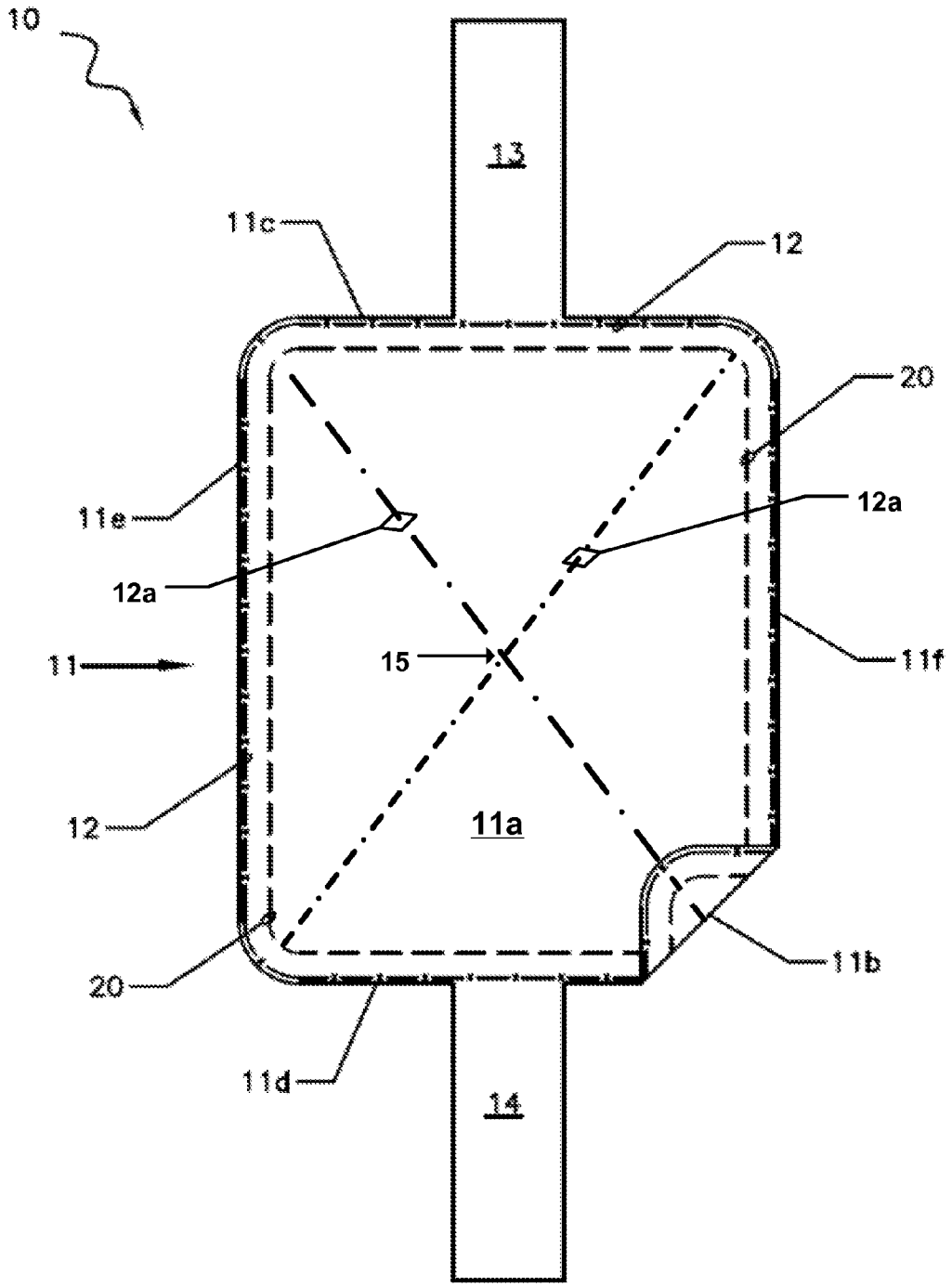
FIG. 4 is a front view of a back and body washing device, in accordance with one embodiment of the invention.

As noted above, the device 10 can include an unlimited number of different shapes, sizes and construction materials. Accordingly, FIG. 3 illustrates another embodiment of the device 10 that includes an oval shaped center portion 11 that is integrally constructed with the handles 13 and 14, and having the liner 20 positioned throughout.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A back and body washing device, said device comprising:

a central main body section having a front surface, a rear surface, a top edge, a bottom edge and pair of opposing side edges, each of the front and rear surfaces consisting of identical pieces of soft absorbent material;

an elongated inelastic top handle section that extends outward from the top edge of the main body section;

an elongated inelastic bottom handle section that extends outward from the bottom edge of the main body section; and a liner that is interposed between an entirety of each of the identical front and rear surfaces of the main body section, said liner including an interface material that functions to prevent the main body section from changing shape.

2. The device of claim 1, wherein said material consists of cotton terrycloth.

3. The device of claim 1, wherein the liner is constructed from a fiber makeup of about 85 percent polyester and 15 percent viscose.

4. The device of claim 1, wherein the front and rear surfaces are secured together via a seam connector.

5. The device of claim 4, wherein each of the top and bottom handle sections are secured to the main body sections via another seam connector.

6. The device of claim 5, wherein each of the seam connector and the another seam connector include at least one of a plurality of stitches, liquid seams, and hem tape.

7. The device of claim 1, wherein each of the main body section and the top and bottom handle sections include an integral construction.

8. The device of claim 1, wherein the central main body includes a generally rectangular shape.

9. The device of claim 1, wherein the central main body includes a generally oval shape.

10. The device of claim 1, further comprising:

a first and second pair of diagonal stitches that are disposed along each of the identical front and rear surfaces, respectively, each of said diagonal stitches being configured to reinforce a middle section of the central main body to prevent the main body section from changing shape.

11. The device of claim 1, wherein the central main body section includes a length of 11 inches, and a width of 9 inches; and each of the top and bottom handle sections include a length of 8 inches and a width of 4 inches.

12. A back and body washing device, consisting of:

a central main body section having a front surface, a rear surface, a top edge, a bottom edge and pair of opposing side edges, each of the front and rear surfaces consisting of identical pieces of soft absorbent material;

an elongated inelastic top handle section that extends outward from the top edge of the main body section;

an elongated inelastic bottom handle section that extends outward from the bottom edge of the main body section; and a liner that is interposed between an entirety of each of the identical front and rear surfaces of the main body section, said liner including an interface material that functions to prevent the main body section from changing shape.

13. The device of claim 12, further comprising:

a first and second pair of diagonal stitches that are disposed along each of the identical front and rear surfaces, respectively, each of said diagonal stitches being configured to reinforce a middle section of the central main body to prevent the main body section from changing shape.

14. The device of claim 12, wherein the central main body section includes a length of 11 inches, and a width of 9 inches; and each of the top and bottom handle sections include a length of 8 inches and a width of 4 inches.

* * * * *